US006661396B2

(12) United States Patent
Yabuki

(10) Patent No.: US 6,661,396 B2
(45) Date of Patent: Dec. 9, 2003

(54) DISPLAY DEVICE

(75) Inventor: Masanori Yabuki, Stuttgart (DE)

(73) Assignee: Alpine Electronics, Inc., Tokyo (JP)

( * ) Notice: Subject to any disclaimer, the term of this patent is extended or adjusted under 35 U.S.C. 154(b) by 138 days.

(21) Appl. No.: 09/840,750

(22) Filed: Apr. 23, 2001

(65) Prior Publication Data

US 2002/0000953 A1 Jan. 3, 2002

(30) Foreign Application Priority Data

Apr. 25, 2000 (JP) ..... 2000-124177

(51) Int. Cl.[7] ..... G09G 3/30
(52) U.S. Cl. ..... 345/76; 345/33; 345/45
(58) Field of Search ..... 345/55, 76, 77, 345/82, 83, 33, 30, 43, 44, 45, 87, 103; 315/169.3

(56) References Cited

U.S. PATENT DOCUMENTS

| | | | | | |
|---|---|---|---|---|---|
| 2,958,009 | A | * | 10/1960 | Bowerman, Jr. | 345/45 |
| 3,354,342 | A | * | 11/1967 | Ohtrup et al. | 313/500 |
| 4,839,636 | A | * | 6/1989 | Zeiss | 345/30 |
| 5,119,417 | A | * | 6/1992 | Suzuki et al. | 379/354 |
| 5,218,399 | A | * | 6/1993 | Izumi et al. | 396/292 |
| 5,297,119 | A | * | 3/1994 | Tonegawa et al. | 368/41 |
| 5,500,711 | A | * | 3/1996 | Sasapaki et al. | 396/287 |
| 5,659,822 | A | * | 8/1997 | Sasagaki et al. | 345/467 |
| 6,032,021 | A | * | 2/2000 | Sato | 345/55 |
| 6,208,083 | B1 | * | 3/2001 | Suzuki et al. | 345/103 |
| 6,307,322 | B1 | * | 10/2001 | Dawson et al. | 345/76 |
| 6,341,994 | B1 | * | 1/2002 | Ootsuki et al. | 445/24 |

FOREIGN PATENT DOCUMENTS

| | | | |
|---|---|---|---|
| EP | 1 024 472 A2 | 2/2000 | |
| EP | 1 030 285 A1 | 8/2000 | G09G/3/12 |
| WO | WO 00/14709 | 3/2000 | G09G/3/12 |

* cited by examiner

*Primary Examiner*—Xiao Wu
(74) *Attorney, Agent, or Firm*—Brinks Hofer Gilson & Lione

(57) ABSTRACT

The object of the present invention is to provide an image display device capable of radiating over an image formed into a character with a uniform luminosity as a luminescent surface made according to the dot matrix system without increasing the number of components.

To this end, the display device includes the first luminescent section having a prescribed area and the second luminescent section constituting a display with an area larger than that of the first luminescent section, wherein the first and the second luminescent sections include luminescent bodies radiating as electrons move and a pair of electrodes sandwiching these luminescent bodies, at least one of these electrodes determines the luminescent area thereof, and the second luminescent section is constituted by a plurality of divided electrodes.

12 Claims, 4 Drawing Sheets

DISPLAY DEVICE

BACKGROUND OF THE INVENTION

1. Field of the Invention

This invention relates to a display device used in electronic equipment and for displaying various character information and characters, in particular to a display device for displaying pictures by using organic electroluminescent (EL) elements in the display section.

2. Description of Related Art

As a flat-type display device based on the dot matrix display system, there is a display device in which luminescent elements such as organic electroluminescent (EL) elements are used. A luminescent element based on organic electroluminescent (EL) elements (hereinafter referred to as "organic EL element") is an element composed basically of a luminescent layer made of laminated fluorescent material in which electrodes of a small work function (electrodes for injection of electrons) are formed. Such organic EL elements are characterized by their ability to provide a very high luminance for a small voltage.

As shown in FIG. 6, a display device in which organic EL element is used 21 (hereinafter referred to simply as "the display device") has organic layers (luminescent layers) 22*a* and 22*b* sandwiched between a plurality of common line electrodes 23 serving as negative poles and a plurality of segment line electrodes 24 serving as positive electrodes, and disposed between the transparent (glass) substrates 25 and 26. Any potential difference given between the common line electrodes 23 and the segment line electrodes 24 creates an electric field between the organic layers 22*a* and 22*b*, and electrons accelerated by this electric field creates electron-hole pairs. Alternatively, the application of an electric field may result in the disappearance of electron-hole pairs. The area of the part radiating at this time (hereinafter referred to as the "luminescent surface") will be the area of individual electrodes for injection of electrons sandwiching the organic layers 22*a* and 22*b*.

Display devices developed in recent years adopted the dot matrix system for chronologically changing pictures and figures specifically formed for each character for fixed pictures. As figures specifically formed for each character are used for fixed pictures, curves can be used freely and freedom of display may be enhanced. A display device including both a display section based on a prior dot matrix system and a display section for displaying a figure formed into a specific character will be explained with reference to FIGS. 6 and 7.

The display device 21 includes a dot display portion 27 based on the dot matrix system, which is connected with a line electrode drive circuit 28 and a column electrode drive circuit 29 providing a potential difference to the organic layer 22*a*. Line electrode drive circuit 28 and column electrode drive circuit 29 are connected with the control section 30. Similarly, the display device 21 includes a figure display portion 31 for displaying a figure formed into a character, which is connected with a line electrode drive circuit 32 and a column electrode drive circuit 33 providing a potential difference to the organic layer 22*b*. The line electrode drive circuit 32 and column electrode drive circuit 33 are connected with the control section 34. Control sections 30 and 34 are designed to receive inputs of image signals and based on these image signals each of these control sections 30 and 34 control the line electrode drive circuits 28 and 32 and column electrode drive circuits 29 and 33 to change the potential differences given to the organic layers 22*a* and 22*b* of the dot display portion 27 and the figure display portion 31.

In case where the dot matrix system is used for displaying any picture, the reduction of each dot or radiating surface to a small area produces clearer pictures. On the other hand, where a figure formed into a specific character is to be displayed, the enlargement of the figure itself for display makes it easier to view. Thus, a figure formed into a character tends to grow far larger than a dot adopted for the dot matrix system. In other words, the area of electrodes into which electrons are injected to radiate a figure formed into a character on the organic layer 22*b* grows larger than the area of an electrode into which electrons are injected to radiate according to the dot matrix system. Therefore, even if the same potential difference is given to both of the organic layers 22*a* and 22*b*, the amount of electric current flowing into the latter organic layer 22*b* grows smaller. As a result, in comparison with the luminescent area of each dot according to the dot matrix system, the luminescent surface of the figure formed into a character grows darker.

For the above reason, in order to maintain the luminosity of the luminescent surface of the figure formed into a character at a level of luminosity similar to that of the luminescent surface of each dot displayed according to the dot matrix system, the potential difference between the common line electrodes and the segment line electrodes must be kept at a higher level than the potential difference applied to the organic layer 22*a* radiating according to the dot matrix system. Therefore, apart from the common line electrodes, the segment line electrodes, the line electrode drive circuit and the column electrode drive circuit for supplying electric current to the organic layer 22*a* radiating according to the dot matrix system, new common line electrodes, segment line electrodes, line electrode drive circuit and column electrode drive circuit must be created to provide for further potential difference, which resulted in additional components, further complication of the control section and added up the cost.

SUMMARY OF THE INVENTION

It is therefore an object of the present invention to provide a display device by which a figure formed into a character can radiate with an even luminosity as that of the luminescent surface according to the dot matrix system without increasing the number of components.

In order to solve the above problem, the display device according to one embodiment of the present invention includes the first luminescent section of a prescribed area and the second luminescent section forming a picture of an area larger than the first luminescent section, the first and the second luminescent sections being formed by a luminescent body radiating as electrons move and a pair of electrodes sandwiching this luminescent body, at least one of the electrodes determining the area of radiation, and at least the second luminescent section being formed by a plurality of divided electrodes.

In another embodiment, the display device according to the present invention includes a drive circuit for driving the segment line electrodes and common line electrodes for supplying electric current to the first luminescent section, and the drive circuit drives the second luminescent section.

In still another embodiment, the display device according to the present invention includes electrodes forming the second luminescent section divided so that each of them would take the same area as that of the first luminescent section.

In still another embodiment, the present invention provides a display device in which the electrodes of the second luminescent section are disposed in such a way as to form at least a character and the electrodes are divided by slits crossing with characters.

In another embodiment, the present invention provides a display device in which slits are formed by a line smaller than characters.

The presently preferred embodiment includes a first luminescent section of a prescribed area, i.e. a dot of the dot display portion 2, and a second luminescent section displaying a figure of an area larger than that of said first luminescent section, i.e. a figure display portion 3. As electrons move between the pair of electrodes sandwiching the first or second luminescent sections, the luminescent body radiates. The area of luminescence is determined by at least one of the electrodes. If the electrode of the second luminescent section is divided into a plurality of electrodes such that the area of each divided subsection of the second luminescent section becomes close to that of the first luminescent section, the luminosity of the second luminescent section can be brought to the same level of luminosity as that of the first luminescent section even if the same potential difference is applied.

By including a drive circuit for driving the segment line electrodes and the common line electrodes for supplying electric current to the first luminescent section and the use of this drive circuit to drive the second luminescent section, the display device according to the present invention can better apply a potential difference to the second luminescent section without increasing the number of components.

By utilizing a plurality of electrodes in the second luminescent section in order to provide luminescent subsections with an area substantially the same as the area of the first luminescent section, the display device according to the present invention can more accurately radiate the first and the second luminescent sections with an even luminosity by applying a similar potential difference to them.

By forming electrodes of the second luminescent section as slits which cross with the display characters, the display device according to the present invention enhances a user's ability to distinguish lines constituting characters from slits even when the second luminescent section contains characters. Thus, visual recognizability is not impaired.

Further, the electrodes of the second luminescent section may be constructed with a width substantially smaller than the width of the lines constituting characters. This also reduces the likelihood of impaired visual recognizability.

DESCRIPTION OF THE PREFERRED EMBODIMENTS

Figure 1:
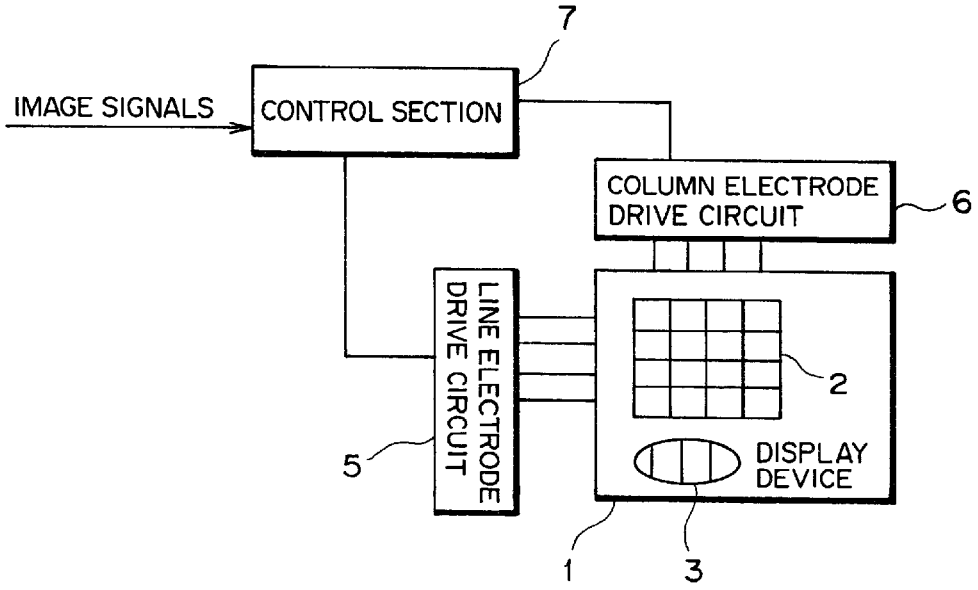
FIG. 1 is a schematic block diagram showing the interconnection of one embodiment of the display device of the present invention.
Figure 2:
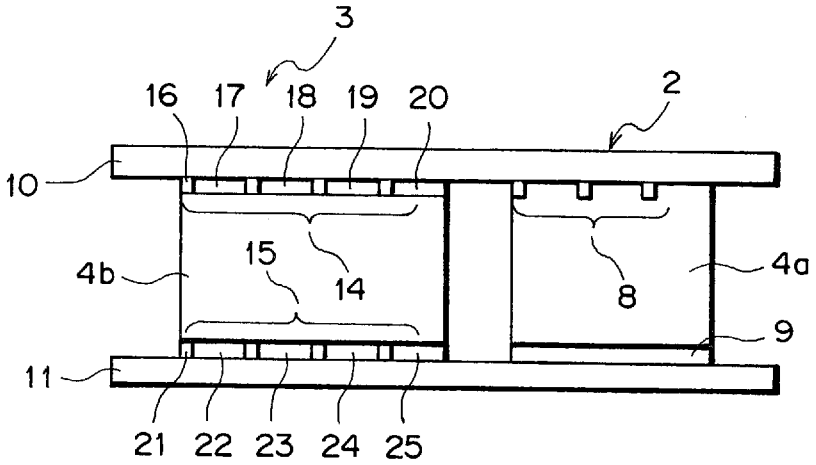
FIG. 2 is a schematic illustration of the dot display portion of the display device according to one embodiment of the present invention.
Figure 3:
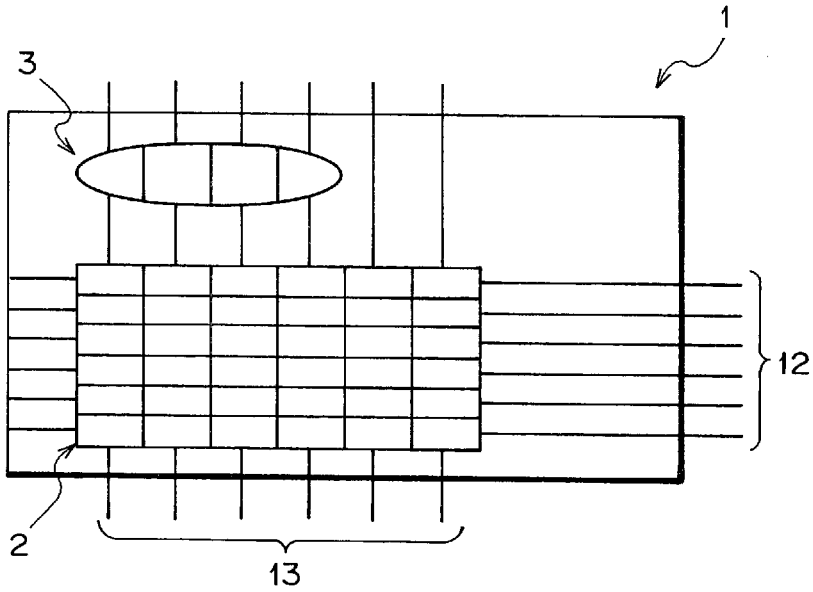
FIG. 3 is a schematic sectional view of the display device according to one embodiment of the present invention.
Figure 4:
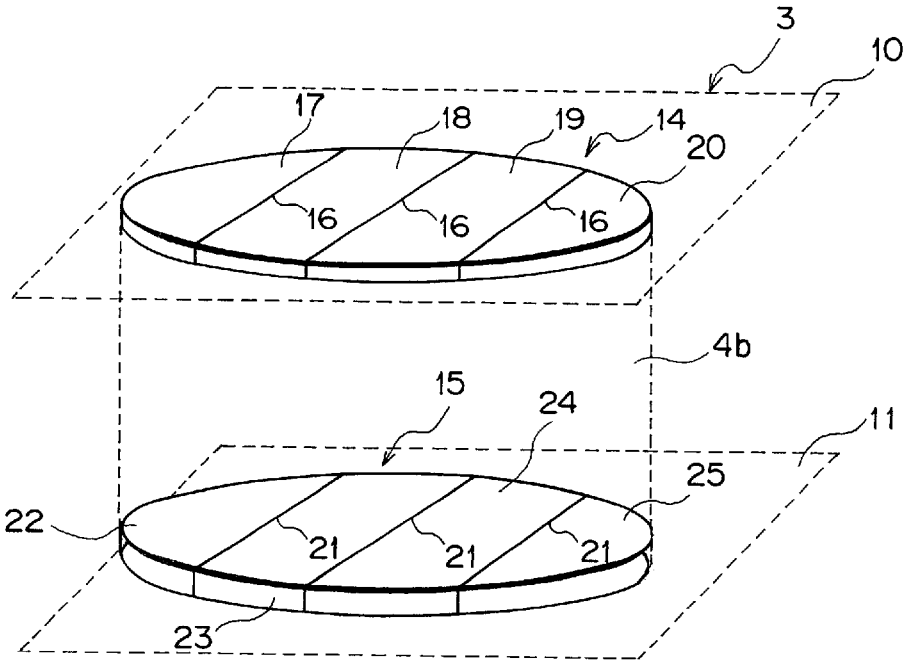
FIG. 4 is a schematic illustration of the figure display portion according to a first embodiment of the present invention.
Figure 5:
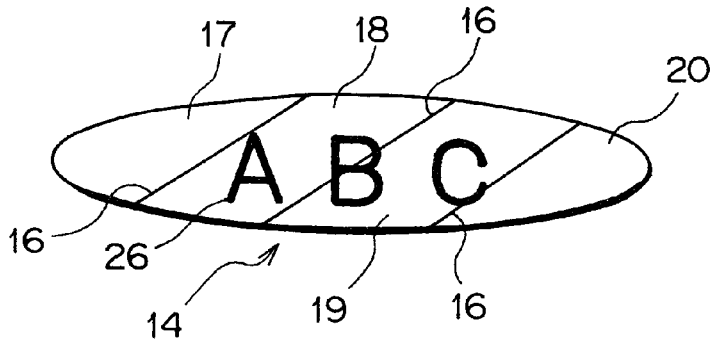
FIG. 5 is a perspective view showing the figure display portion according to a second embodiment of the present invention.
Figure 6:
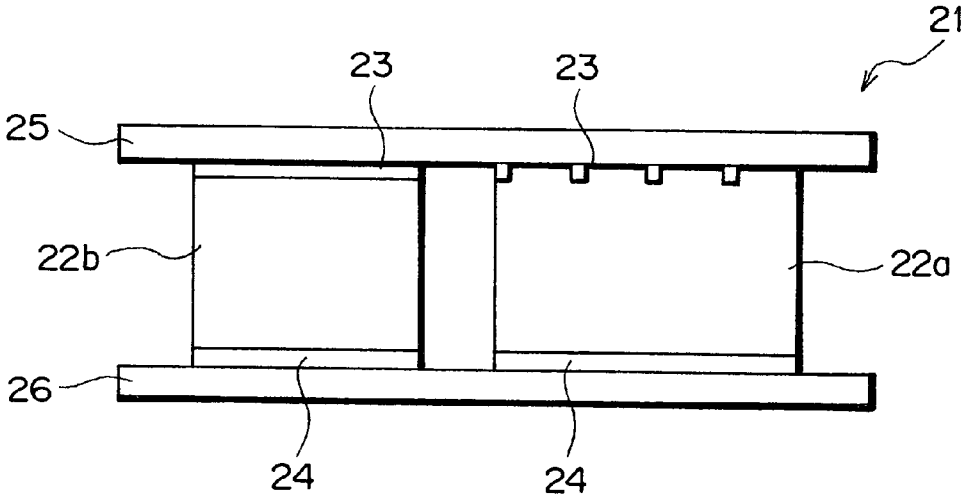
FIG. 6 is a sectional view of a prior display device.
Figure 7:
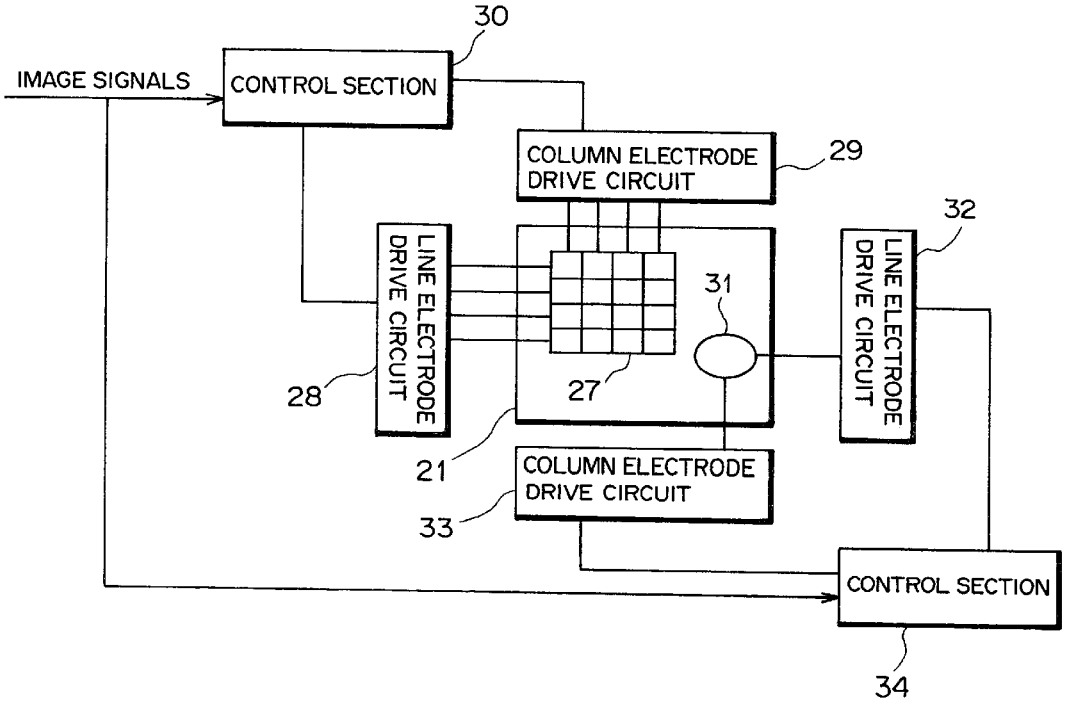
FIG. 7 is a schematic block diagram showing the interconnection of a prior display device.

Referring to FIGS. 1 to 5, preferred embodiments of the present invention will be explained. Incidentally, FIG. 1 is a schematic block diagram showing the interconnection of the display device according to one embodiment of the present invention, FIG. 2 is a schematic illustration of the dot display portion of the display device according to one embodiment of the present invention, FIG. 3 is a schematic sectional view of the display device according to one embodiment of the present invention, FIG. 4 is a schematic illustration of the figure display portion according to a first embodiment of the present invention, and FIG. 5 is a perspective view showing the figure display portion according to a second embodiment of the present invention.

As shown in FIG. 1, a display device 1 according to one embodiment of the present invention includes a dot display portion 2 for displaying according to the dot matrix system and a figure display portion 3 for displaying a figure formed into a character. The display device 1 is connected with a line electrode drive circuit 5 and a column electrode drive circuit 6 for applying a potential difference to each of organic layers 4*a* and 4*b* of the dot display portion 2 and the figure display portion 3. And the line electrode drive circuit 5 and the column electrode drive circuit 6 are connected with a controller 7.

The controller 7 is designed to control the line electrode drive circuit 5 and the column electrode drive circuit 6 so that the line electrode drive circuit 5 and the column electrode drive circuit 6 may cause changes in the potential difference applied to each of the organic layers 4*a* and 4*b* of the dot display portion 2 and the figure display portion 3. Image signals are to be inputted thereto for this purpose.

Then, as shown in FIG. 2, the dot display portion 2 includes an organic layer 4*a*, a plurality of common line electrodes serving as negative electrodes 8, a plurality of segment line electrodes serving as positive electrodes 9, the organic layer 4*a* being sandwiched between the common line electrodes 8 and the segment line electrodes 9 and disposed furthermore between transparent (glass) substrates 10 and 11. The dot display portion 2, the common line electrodes 8 are connected with the line electrode drive circuit 5 through their connecting line 12 and the segment line electrodes 9 are connected with the column electrode drive circuit 6 through their connecting line 13. In addition, as shown in FIG. 3, the common line electrodes 8 are disposed on the lower surface of the glass substrate 10 in parallel each other, and segment line electrodes 9 are disposed on the upper surface of the glass substrate 11 in parallel each other and in the vertical direction to the common line electrodes 8.

The application of a potential difference between the common line electrodes 8 and the segment line electrodes 9 by the operation of the line electrode drive circuit 5 and the column line electrode drive circuit 6 generates an electric field on the organic layer 4*a*, and electrons accelerated by this electric field generates electron-hole pairs, or electrons at the center of radiation are excited resulting in the disappearance of electron-hole pairs when electrons returns to their normal state from a state of excitation. The area of luminescent section at this time will be the area of a section where individual common line electrode 8 and segment line electrode 9 crosses sandwiching the organic layer 4*a* (electrodes subject to the injection of electrons).

As shown in FIGS. 2 and 4, the figure display portion 3 includes an organic layer 4*b*, common-line electrodes 14 and segment-line electrodes 15, the organic layer 4*b* being sandwiched between the common-line electrodes 14 and the segment-line electrodes 15, and disposed furthermore between the glass substrates 10 and 11. In addition, the common-line electrodes 14 and the segment-line electrodes 15 are respectively disposed on the glass substrates 10 and 11, and the common-line electrodes 14 and the segment-line electrodes 15 facing each other on the opposite sides have identical shapes. The common-line electrodes 14 are divided by a plurality of slits 16 into a plurality of common-line electrodes 17, 18, 19 and 20. Similarly, the segment-line electrodes 15 are divided by a plurality of slits 21 into a plurality of segment-line electrodes 22, 23, 24 and 25. These divided common-line electrodes 17, 18, 19 and 20 and segment-line electrodes 22, 23, 24 and 25 are disposed in such a way that the electrodes facing each other on the opposite sides, for example common-line electrodes 17 and segment-line electrodes 22, have identical shapes and identical areas.

Each of the common-line electrodes 17, 18, 19 and 20 and each of the segment-line electrodes 22, 23, 24 and 25 are divided by the slits 16 and 21 in such a way that each electrode would have more or less the same area, and their respective area is more or less the same area as a display area of the dot display portion 2. Therefore, it is possible to obtain the same luminosity by applying to the organic layer 4*b* a potential difference equal to that applied by the column electrode drive circuit 5 and the line electrode drive circuit 6 to the dot display portion 2.

The common-line electrodes 14 and the segment-line electrodes 15 are respectively connected with the coupling lines 12 and 13, and the application of a potential difference by the column electrode drive circuit 5 and the line electrode drive circuit 6 between each of the common-line electrodes 17, 18, 19 and 20 and each of the segment-line electrodes 22, 23, 24 and 25 generates an electric field on the organic layer 4*b*, and electrons accelerated by this electric field generates electron-hole pairs, or excites electrons at the center of luminescence resulting in the disappearance of the electron-hole pairs or luminescence when the electrons returns from an excited state to the normal state. At this time, the area of the luminescent section will be identical or equal to the area of individual common-line electrode 17, 18, 19, 20 or that of individual segment-line electrode 22, 23, 24 or 25 sandwiching the organic layer 4*b*.

In the second embodiment of the present invention, a display created in the form of a character contains, as shown in FIG. 5, alphabets and other letters 26. And the slit 16 is provided in order to prevent that lines constituting the letter "A" from having the same inclination as the slit. Thus, when the display created as a character contains letters, the setting of a different inclination of the slit 16 from that of the line constituting said letters enables a viewer to distinguish the line constituting the letters and therefore maintains visual recognizability. Further, the choice of a narrower width of the slit than that of the line constituting said letter also avoids impairing the visual recognizability of the lines constituting letters contained in a picture formed as a characters. Incidentally, in this second embodiment, the other elements are the same as those of the first mode of carrying out and therefore explanations thereon are omitted.

It is to be understood that a wide range of changes and modifications to the embodiments described above will be apparent to those skilled in the art and are contemplated. It is therefore intended that the foregoing detailed description be regarded as illustrative, rather than limiting, and that it be understood that it is the following claims, including all equivalents, that are intended to define the spirit and scope of the invention.

What is claimed is:

1. A display device comprising:

a first substrate;

a second substrate;

dot matrix display formed of electroluminescent material, said dot matrix display comprising a plurality of dot display portions, a first plurality of electrodes connected with said dot display portions and said first substrate, and a second plurality of electrodes connected with said dot display portions and said second substrate;

a figure display formed of electroluminescent material, said figure display comprising a plurality of figure display portions, a third plurality of electrodes connected with said figure display portions and said first substrate, and a fourth plurality of electrodes connected with said figure display portions and said second substrate;

wherein the area of the figure display is larger than the area of one of said dot display portions, said figure display potions are separated by at least one slit, and an area of luminescence of each of said figure display portions is formed by applying one of said third plurality of electrodes and one of said fourth plurality of electrodes to said figure display.

2. The display device of claim 1 further comprising:

a drive circuit for driving said first plurality of electrodes and said third plurality of electrodes and said second plurality of electrodes and said fourth plurality of electrodes for supplying electric current to said plurality of dot display portions and said plurality of figure display portions.

3. The display device of claim 1 wherein the area of each of the figure display portions is substantially the same as the area of each of the dot display portions.

4. The display device of claim 1 wherein said figure display portions are shaped to display at least one character.

5. The display device of claim 4 wherein said slit is formed by a line finer than said character.

6. The display device of claim 4 wherein said slit is aligned with a different inclination than said character.

7. The display device of claim 1 wherein said dot display is formed of organic electroluminescent material.

8. The display device of claim 1 wherein said figure display is formed of organic electroluminescent material.

9. The display device of claim 1 wherein the area of each of said third plurality of electrodes is the same as the area of each of said dot display portions.

10. The display device of claim 1 wherein the area of each of said fourth plurality of electrodes is the same as the area of each of said dot display portions.

11. The display device of claim 4 wherein said character is a letter.

12. The display device of claim 4 wherein said character is a number.

* * * * *